US008569968B2

(12) United States Patent
Hsiao et al.

(10) Patent No.: US 8,569,968 B2
(45) Date of Patent: Oct. 29, 2013

(54) METHOD FOR ADJUSTING LIGHT BRIGHTNESS USING A TOGGLE SWITCH AND RELATED ILLUMINANT SYSTEM

(75) Inventors: En-Hsun Hsiao, New Taipei (TW); Chin-Yen Huang, New Taipei (TW)

(73) Assignee: Princeton Technology Corporation, Xindian Dist., New Taipei (TW)

( * ) Notice: Subject to any disclaimer, the term of this patent is extended or adjusted under 35 U.S.C. 154(b) by 292 days.

(21) Appl. No.: 13/092,123

(22) Filed: Apr. 21, 2011

(65) Prior Publication Data

US 2012/0098447 A1 Apr. 26, 2012

(30) Foreign Application Priority Data

Apr. 23, 2010 (TW) ..... 99112898 A

(51) Int. Cl.

*H05B 37/02* (2006.01)
*H05B 41/18* (2006.01)
*H05B 41/38* (2006.01)

(52) U.S. Cl.

USPC ..... 315/291; 315/313

(58) Field of Classification Search

USPC ..... 315/291, 217, 186, 298, 292, 313, 314, 315/316

See application file for complete search history.

(56) References Cited

U.S. PATENT DOCUMENTS

2009/0190338 A1* 7/2009 Huang ..... 362/184
2011/0109249 A1* 5/2011 Liu et al. ..... 315/307

* cited by examiner

*Primary Examiner* — Daniel D Chang
(74) *Attorney, Agent, or Firm* — Winston Hsu; Scott Margo

(57) ABSTRACT

A method for adjusting the brightness of a light source is performed according to the status of input voltage which is determined by detecting how and how many times a toggle switch switches state. When a user switches the state of the toggle switch for the first time in order to turn on/off the light, the brightness of the light source gradually increases/decreases within a dimmer period, during which the user may select an appropriate brightness of the light source by giving a swift double-toggle on the toggle switch.

8 Claims, 5 Drawing Sheets

METHOD FOR ADJUSTING LIGHT BRIGHTNESS USING A TOGGLE SWITCH AND RELATED ILLUMINANT SYSTEM

BACKGROUND OF THE INVENTION

1. Field of the Invention

The present invention is related to a method for adjusting light brightness and a related illuminant system, and more particularly, to a method for adjusting light brightness set using a toggle switch and a related illuminant system.

2. Description of the Prior Art

FIG. 1 is a diagram illustrating a prior art illuminant system 100. The illuminant system 100 includes a switch 110, a light source 120, and a ballast 130. The switch 110 is a traditional toggle switch which operates in two states: ON and OFF. When a user turns on the switch 110, electricity (such as 110V-220V AC main) is transmitted to the ballast 130 for turning on the light source 120. Although having a simple structure, the prior art illuminant system 100 does not provide dimmer function for brightness adjustment since the light source 120 can only be switched on or off using the traditional toggle switch 110.

FIG. 2 is a diagram illustrating another prior art illuminant system 200. The illuminant system 200 includes a switch 210, a light source 120, and a ballast 130. The switch 210 is a rotary switch which operates in two states ON and OFF and also provides dimmer function. For example, when a user rotates the switch 210 in the clockwise direction, electricity is transmitted to the ballast 130 for turning on the light source 120, and the brightness of the light source 120 is determined by the rotational angle of the switch 210. In order to provide dimmer function, the prior art illuminant system 200 requires the special rotary switch 210.

SUMMARY OF THE INVENTION

The present invention provides a method for adjusting a brightness of a light source using a toggle switch. The method includes identifying a first state of the toggle switch when the light source is in an initial state; gradually adjusting the brightness of the light source from a first brightness to a second brightness during a dimmer period after the toggle switch changes from the first state to a second state at a first time point; and maintaining the brightness of the light source at the value obtained from the second time point when the toggle switch changes from the second state to the first state at a second time and then changes from the first state to the second state at a third time point, wherein a first dimmer period through the second time point to the third time point does not exceed a turn-off time.

The present invention also provides an illuminant system having dimmer function and including a power supply circuit, a switch, a feedback circuit, a detection circuit, a control circuit, and an input circuit. The power supply circuit is configured to convert an input signal into a power signal. The switch is configured to control a signal transmission path between the input signal and the power supply circuit. The feedback circuit is configured to generate a feedback signal by detecting a current flowing through a light source. The detection circuit is configured to generate a dimmer input signal according to a switching number and a switching mode of the switch. The control circuit is configured to generate a driving signal according to the power signal, the dimmer input signal and the feedback signal. The input circuit is configured to drive the light source according to the driving signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
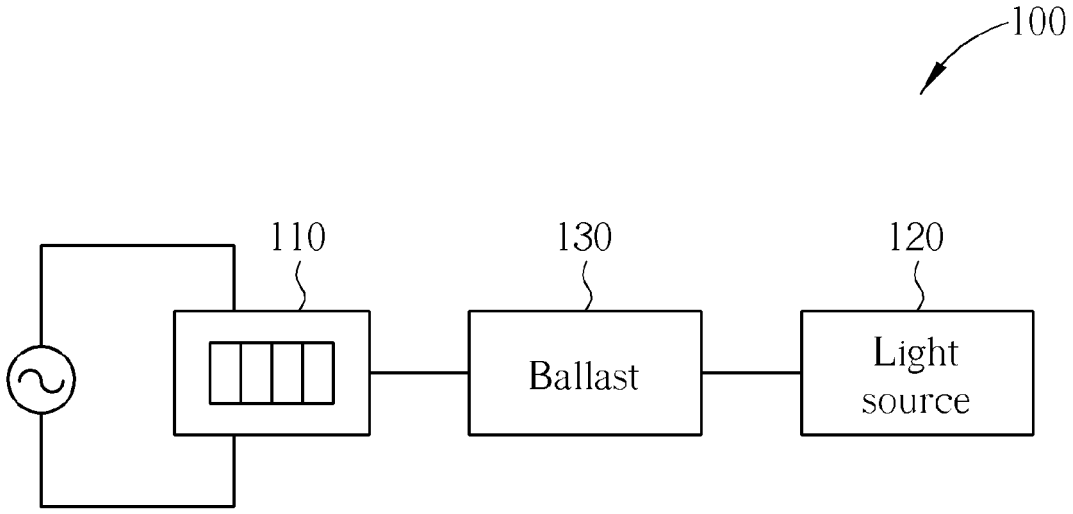
FIG. 1 PRIOR ART
FIG. 1 is a diagram illustrating a prior art illuminant system.
Figure 2:
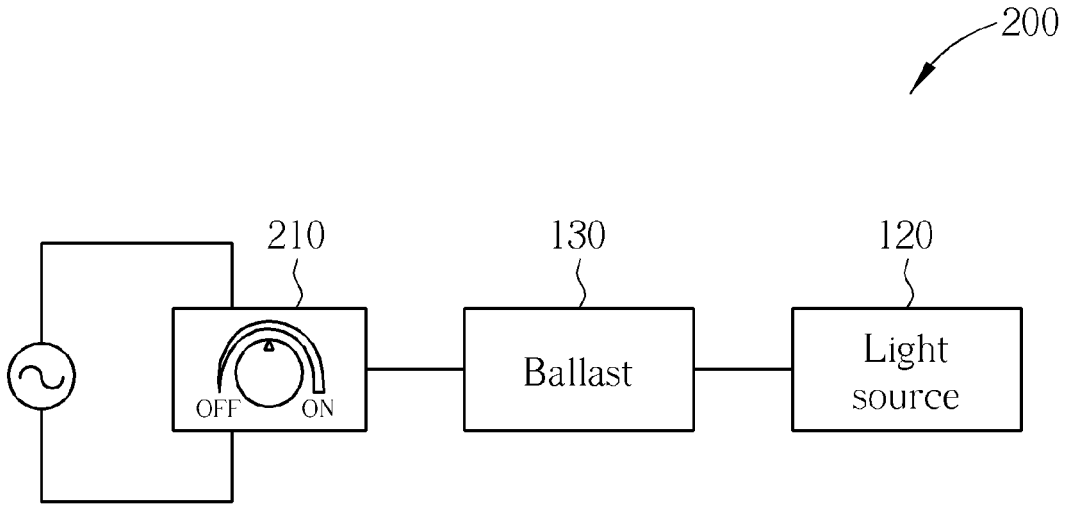
FIG. 2 PRIOR ART
FIG. 2 is a diagram illustrating another prior art illuminant system.
Figure 3:
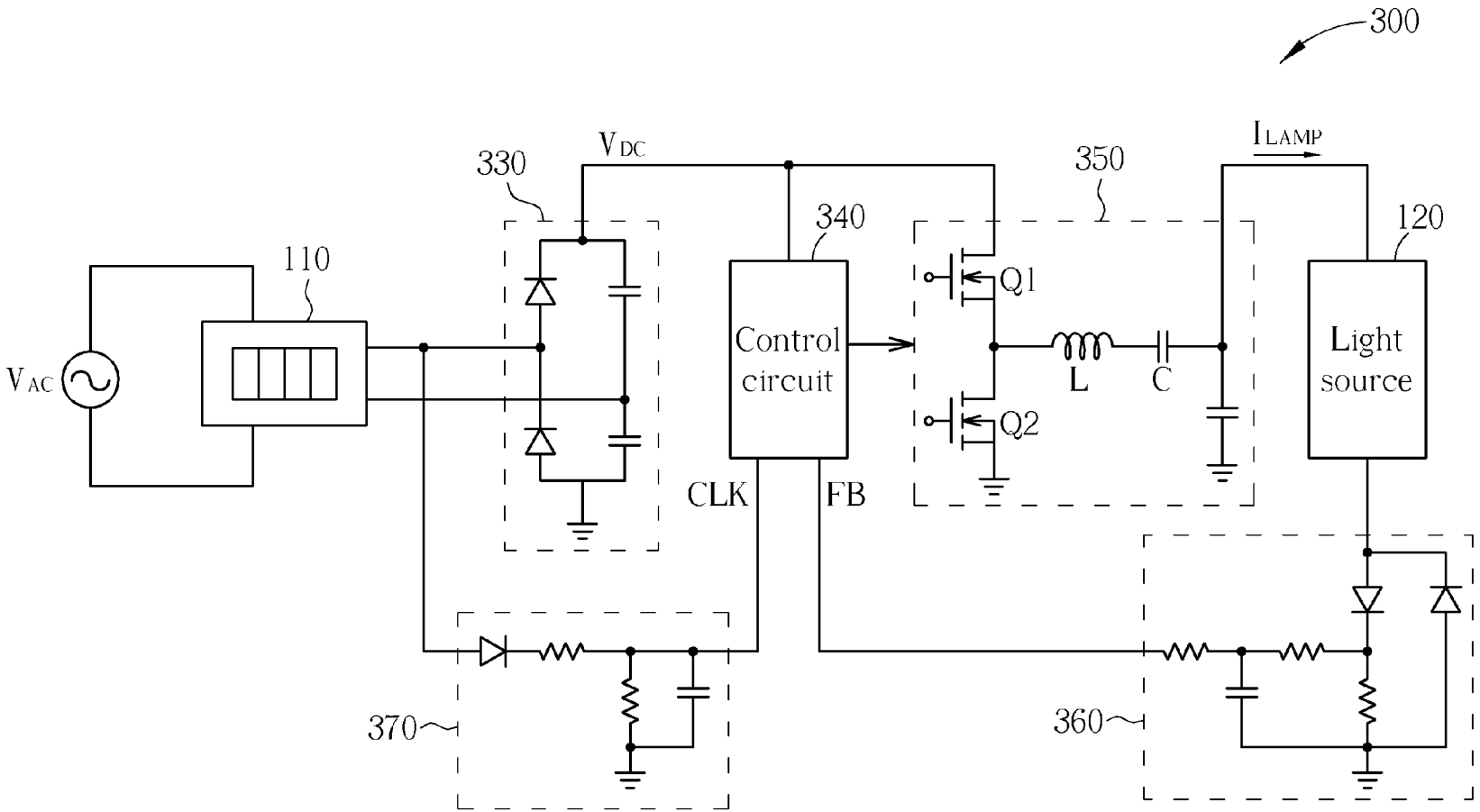
FIG. 3 is a diagram illustrating an illuminant system according to the present invention.

FIG. 3 is a diagram illustrating an illuminant system 300 according to the present invention. The illuminant system 300 includes a switch 110, a light source 120, a power supply circuit 330, a control circuit 340, an output circuit 350, a feedback circuit 360, and a detection circuit 370. The switch 110 is a traditional toggle switch, with which the user may turn on or turn off the light source 120 by changing the state of the switch 110. In the embodiment depicted in FIG. 3, the illuminant system 300 only includes one switch 110 which operates in "ON" state and "OFF" state respectively corresponding to the switch-on and switch-off of the light source 120. However in other applications, the illuminant system 300 may include multiple switches 110 so as to allow the user to turn on or turn off the light source 120 at different locations. In this case, when a specific switch 110 changes its current state, the light source 120 may be turned on or turned off, depending on its initial state. For ease of explanation, the two states of the switch 110 are referred to as "first state" and "second state" hereafter. If the user changes the state of the switch 110 (such as from the first state to the second state, or vice versa) when the light source 120 is initially off, an alternative-current (AC) signal $V_{AC}$ (such as 110V-220V main AC voltage) may be transmitted to the power supply circuit 330. The power supply circuit 330 is configured to generate a high level direct-current (DC) signal $V_{DC}$ by rectifying the AC signal $V_{AC}$, thereby turning on the light source 120. If the user changes the state of the switch 110 (such as from the first state to the second state, or vice versa) when the light source 120 is initially on, the supply of the AC signal $V_{AC}$ (such as 110V-220V main AC voltage) to the power supply circuit 330 is cut off, thereby turning off the light source 120.

The detection circuit 370 is configured to measure the frequency of the main AC voltage, monitor how and how many times the switch 110 changes states, and provide a dimmer input signal CLK having the same frequency as the AC signal $V_{AC}$. In applications which require multiple lamps, the illuminant system 300 may perform dimmer synchronization according to the dimmer input signal CLK. The operation of the detection circuit 370 will be described in more detail in subsequent paragraphs.

The output circuit 350 may adopt a half-bridge structure which includes two transistors Q1 and Q2, a capacitor C and an inductor L. According to the DC signal $V_{DC}$, the transistors Q1 and Q2 generate a resonating signal whose frequency may be varied by adjusting the switching frequencies of the transistors Q1 and Q2. The inductor L and the capacitor C are configured to convert the resonating signal generated by the transistors Q1 and Q2 into a high-frequency AC current $I_{LAMP}$ for driving the light source 120.

The feedback circuit 360 is configured to measure the current $I_{LAMP}$ which flows through the light source 120, thereby outputting a corresponding feedback signal FB to the control circuit 340. Therefore, the control circuit 340 may adjust the switching frequencies of the transistors Q1 and Q2 according to the current $I_{LAMP}$, thereby providing a negative feedback close-loop current control for stabilizing the current $I_{LAMP}$.

The control circuit 340 may be, but not limited to, a ballast chip which provides functions such as pre-heat, ignition and dimmer. In the present invention, the control circuit 340 is configured to operate the output circuit 350 according to the dimmer input signal CLK generated by the detection circuit 370 and the feedback signal FB generated by the feedback circuit 360, thereby adjusting the brightness of the light source 120.

Figure 4:
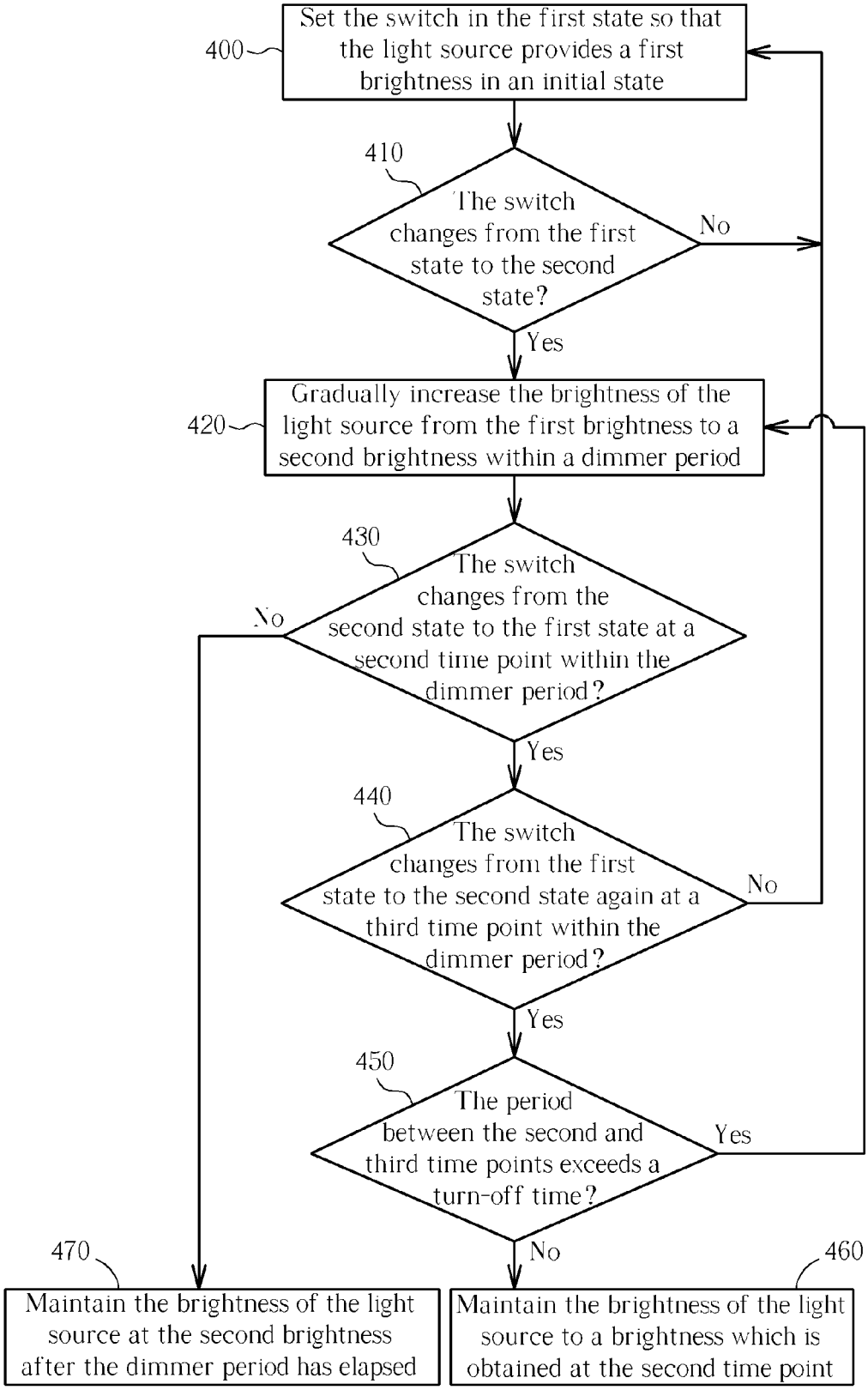
FIGS. 4 and 5 are flowcharts illustrating the operation of the illuminant system according to the present invention.

FIG. 4 is a flowchart illustrating the operation of the illuminant system 300 according to the present invention. The flowchart in FIG. 4 includes the following steps:

Step 400: set the switch 110 in the first state so that the light source 120 provides a first brightness in an initial state.

Step 410: determine whether the switch 110 changes from the first state to the second state: if yes, execute step 420; if no, execute step 400.

Step 420: after the switch 110 changes from the first state to a second state at a first time point, gradually increase the brightness of the light source 120 from the first brightness to a second brightness within a dimmer period $T_{DIM}$ which starts from the first time point; execute step 430.

Step 430: determine whether the switch 110 changes from the second state to the first state at a second time point T2 within the dimmer period $T_{DIM}$; if yes, execute step 440; if no, execute step 470.

Step 440: determine whether the switch 110 changes from the first state to the second state again at a third time point T3 within the dimmer period $T_{DIM}$ after the switch 110 changes from the second state to the first state at the second time point T2; if yes, execute step 450; if no, execute step 400.

Step 450: determine whether the period between the second time point T2 and the third time point T3 exceeds a turn-off time $T_{OFF}$; if yes, execute step 420; if no, execute step 460.

Step 460: maintain the brightness of the light source 120 at a brightness which is obtained at the second time point T2.

Step 470: maintain the brightness of the light source 120 at the second brightness after the dimmer period $T_{DIM}$ has elapsed.

If the light source 120 is initially off in step 400, the first state of the switch 110 corresponds to the OFF state of the light source 120, the second state of the switch 110 corresponds to the ON state of the light source 120, the first brightness corresponds to zero luminance from the light source 120 when turned off, and the second brightness corresponds to the maximum luminance which the light source 120 may provide. When the user changes the state of the switch 110 for turning on the light, step 420 is executed for gradually increasing the brightness of the light source 120 from the first brightness to the second brightness (such as from zero luminance to the maximum luminance). If the state of the switch 110 is not toggled back within the dimmer period $T_{DIM}$, step 470 is executed for maintaining the brightness of the light source 120 to the second brightness (such as the maximum luminance) after the dimmer period $T_{DIM}$ has elapsed. Within the dimmer period $T_{DIM}$, the user may either turn off the light source 120 by re-toggling the state of the switch 110, or select the brightness of the light source 120 by giving a swift double-toggle on the switch 110. When the user only re-toggles the switch 110 once at the time point T2 within the dimmer period $T_{DIM}$, steps 430, 440 and 400 are sequentially executed for turning off the light source 120 at the time point T2. When the user re-toggles the switch 110 firstly at the time point T2 and secondly at the time point T3 within the dimmer period $T_{DIM}$, two things may be demanded: in the first case, the user wants to turn off the light source 120 at the time point T2 and turn on the light source 120 at the time point T3; in the second case, the user wants to adjust the brightness of the light source 120 at the time point T2. Therefore, the turn-off time $T_{OFF}$ is used for determining which demand these toggles at the time points T2 and T3 imply: if the period between the second time point T2 and the third time point T3 does not exceed the turn-off time $T_{OFF}$, it is determined that brightness adjustment is required and steps 430, 440, 450 and 460 are sequentially executed for maintaining the brightness of the light source 120 at the value obtained at the second time point T2 (such as a specific value between zero luminance and the maximum luminance); if the period between the second time point T2 and the third time point T3 is larger than the turn-off time $T_{OFF}$, it is determined that the light source 120 is required to be turned off at the time point T2 and turned on at the time point T3, and step 420 is executed for raising the brightness of the light source 120 to the second brightness (such as the maximum luminance). In other words, after the light source 120 is turned on, its brightness gradually increases so that the user may select an appropriate brightness by giving a swift double-toggle on the switch 110 within the dimmer period $T_{DIM}$. Therefore, the illuminant system 300 of the present invention may provide dimmer function using a traditional switch without using a special rotary switch.

Similarly, if the light source 120 is initially on in step 400, the first state of the switch 110 corresponds to the ON state of the light source 120, the second state of the switch 110 corresponds to the OFF state of the light source 120, the first brightness corresponds to the maximum luminance which the light source 120 may provide, and the second brightness corresponds to zero luminance from the light source 120 when turned off. When the user changes the state of the switch 110 for turning off the light, step 420 is executed for gradually decreasing the brightness of the light source 120 from the first brightness to the second brightness (such as from the maximum luminance to zero luminance). If the state of the switch 110 is not toggled back within the dimmer period $T_{DIM}$, step 470 is executed for maintaining the brightness of the light source 120 at the second brightness (such as zero luminance) after the dimmer period $T_{DIM}$ has elapsed. Within the dimmer period $T_{DIM}$, the user may either turn on the light source 120 by re-toggling the state of the switch 110, or select the brightness of the light source 120 by giving a swift double-toggle on the switch 110. When the user only re-toggles the switch 110 once at the time point T2 within the dimmer period $T_{DIM}$, steps 430, 440 and 400 are sequentially executed for turning on the light source 120 at the time point T2. When the user re-toggles the switch 110 firstly at the time point T2 and secondly at the time point T3 within the dimmer period $T_{DIM}$, and the period between the second time point T2 and the third time point T3 does not exceed the turn-off time $T_{OFF}$, steps 430, 440, 450 and 460 are sequentially executed for maintaining the brightness of the light source 120 at the value obtained at the second time point T2 (such as a specific value between zero luminance and the maximum luminance). In other words, after the light source 120 is turned off, its brightness gradually decreases so that the user may select an appropriate brightness by giving a swift double-toggle on the switch 110 within the dimmer period $T_{DIM}$. Therefore, the illuminant system 300 of the present invention may provide dimmer function using a traditional switch without using a special rotary switch.

Figure 5:
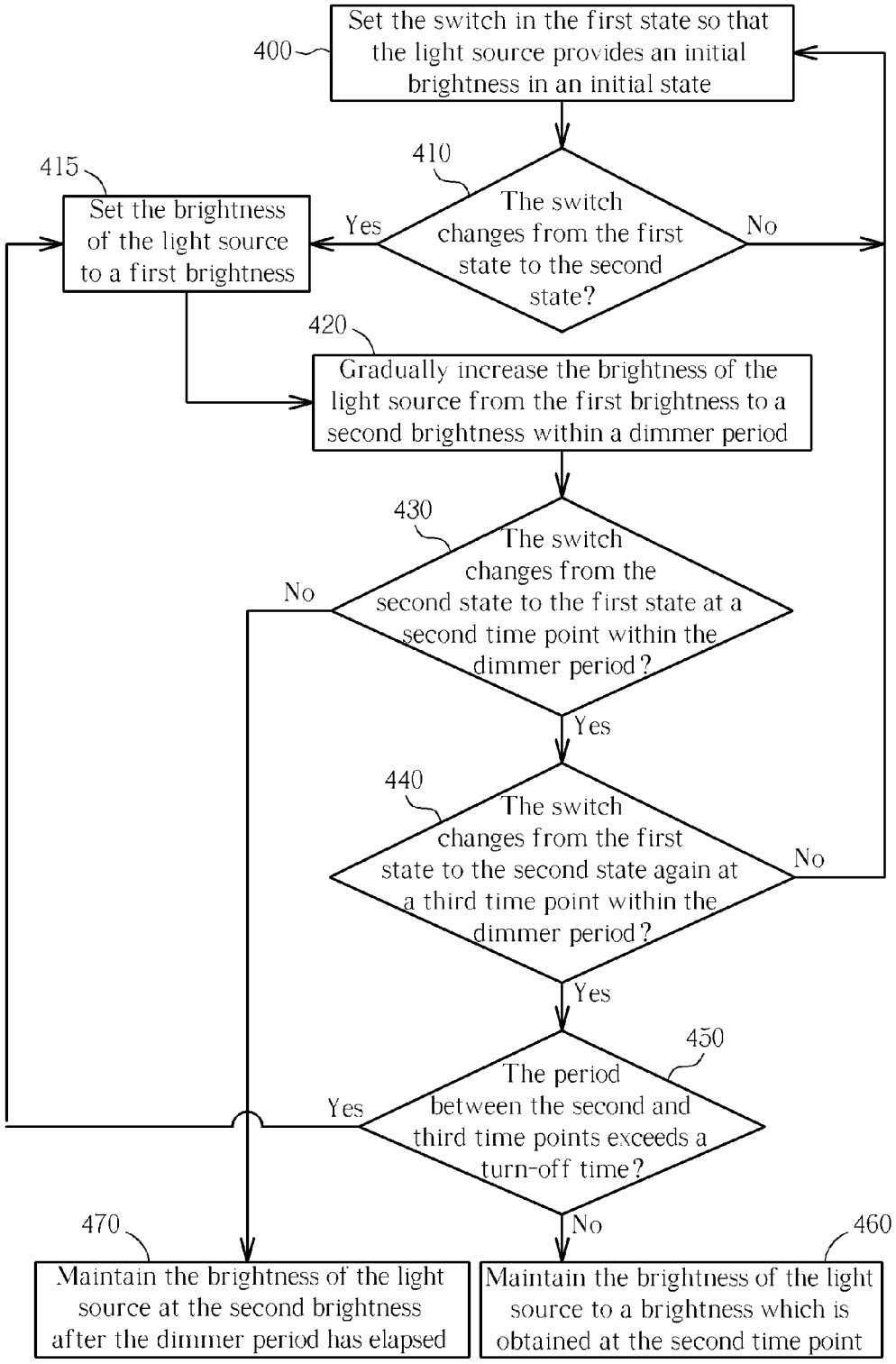

FIG. 5 is a flowchart illustrating the operation of the illuminant system 300 according to the present invention. The flowchart in FIG. 5 includes the following steps:

Step 400: set the switch 110 in the first state so that the light source 120 provides an initial brightness in an initial state.

Step 410: determine whether the switch 110 changes from the first state to the second state: if yes, execute step 415; if no, execute step 400.

Step 415: set the brightness of the light source 120 to a first brightness; execute step 420.

Step 420: gradually increase the brightness of the light source 120 from the first brightness to a second brightness within a dimmer period $T_{DIM}$ which starts from the first time point; execute step 430 after the switch 110 changes from the first state to a second state at a first time point.

Step 430: determine whether the switch 110 changes from the second state to the first state at a second time point T2 within the dimmer period $T_{DIM}$; if yes, execute step 440; if no, execute step 470.

Step 440: after the switch 110 changes from the second state to the first state at the second time point T2, determine whether the switch 110 changes from the first state to the second state again at a third time point T3 within the dimmer period $T_{DIM}$; if yes, execute step 450; if no, execute step 400.

Step 450: determine whether the period between the second time point T2 and the third time point T3 exceeds a turn-off time $T_{OFF}$; if yes, execute step 415; if no, execute step 460.

Step 460: maintain the brightness of the light source 120 at a value which is obtained at the second time point T2.

Step 470: maintain the brightness of the light source 120 at the second brightness after the dimmer period $T_{DIM}$ has elapsed.

Similar to the flowchart in FIG. 4, the embodiment depicted in FIG. 5 further includes step 415. In the embodiment illustrated in FIG. 4, the first brightness refers to the initial brightness of the light source 120 in its initial state, and the brightness of the light source 120 gradually increases from the first brightness to the second brightness when the switch 110 changes state for the first time. In the embodiment illustrated in FIG. 5, the brightness of the light source 120 is set to the first brightness different from its initial brightness and then gradually increases from the first brightness to the second brightness when the switch 110 changes state for the first time. In other words, according to the embodiment depicted in FIG. 5, when the light source 120 is initially off, the first brightness corresponds to the minimum luminance which the light source 120 may provide except zero luminance, and the second brightness corresponds to the maximum luminance which the light source 120 may provide; when the light source 120 is initially on, the first brightness corresponds to the second largest luminance which the light source 120 may provide, and the second brightness corresponds to zero luminance which the light source 120 may provide.

In step 420, the brightness of the light source 120 may be gradually increased or decreased in a linear manner or in a non-linear manner. Or, multiple intermediate values between the first and second brightness may be provided so that the brightness of the light source 120 may be gradually increased or decreased in a stepwise manner. The values of the first brightness, the second brightness, the dimmer period $T_{DIM}$ and the turn-off time $T_{DIMOFF}$ may be determined according to different applications. The light source 120 may include one or more sets of fluorescent tubes, energy-saving tubes, or other types of lighting devices.

The detection circuit 370 according to the present invention is configured to monitor the input status of the AC signal $V_{AC}$, thereby providing the corresponding dimmer input signal CLK according to how and how many times the switch 110 changes state. After the light source 120 is turned on/off, its brightness gradually increases/decreases so that the user may select an appropriate brightness by giving a swift double-toggle on the switch 110 within the dimmer period $T_{DIM}$. Therefore, the illuminant system 300 of the present invention may provide dimmer function using a traditional switch without using a special rotary switch.

Those skilled in the art will readily observe that numerous modifications and alterations of the device and method may be made while retaining the teachings of the invention.

What is claimed is:

1. A method for adjusting a brightness of a light source using a toggle switch, the method comprising:

identifying a first state of the toggle switch when the light source is in an initial state;

gradually adjusting the brightness of the light source from a first brightness to a second brightness during a dimmer period after the toggle switch changes from the first state to a second state at a first time point; and maintaining the brightness of the light source at the value obtained from a second time point when the toggle switch changes from the second state to the first state at the second time point and then changes from the first state to the second state at a third time point, wherein a first dimmer period from the second time point to the third time point does not exceed a turn-off time of the light source.

2. The method of claim 1 further comprising:

maintaining the brightness of the light source at the value of the initial state at the third time point;

gradually adjusting the brightness of the light source from the first brightness to the second brightness during the dimmer period which starts at the third time point;

wherein the toggle switch changes from the second state to the first state at the second time point and then changes from the first state to the second state at the third time point during the dimmer period starting at the third time point; and wherein the period from the second time point to the third time point is larger than the turn-off time.

3. The method of claim 1 further comprising:

adjusting the brightness of the light source from an initial brightness of the initial state to the first brightness after the toggle switch changes from the first state to the second state at the first time point.

4. The method of claim 1 further comprising:

determining whether the toggle switch changes from the second state to the first state within the dimmer period starting at the first time point.

5. The method of claim 4 further comprising:

maintaining the brightness of the light source at the second brightness after the dimmer period starting at the first time point is over;

wherein the toggle switch remains in the second state during the dimmer period starting at the first time point.

6. The method of claim 1 wherein the gradually adjusting step includes gradually adjusting the brightness of the light source from the first brightness to the second brightness in a linear manner.

7. The method of claim 1 wherein the gradually adjusting step includes gradually adjusting the brightness of the light source from the first brightness to the second brightness in a non-linear manner.

8. The method of claim 1 wherein the gradually adjusting step includes gradually adjusting the brightness of the light source from the first brightness to the second brightness in a stepwise manner.

* * * * *